US007004685B2

(12) United States Patent
Creed et al.

(10) Patent No.: US 7,004,685 B2
(45) Date of Patent: Feb. 28, 2006

(54) MECHANICAL DEVICE FOR FLARING A PILING MEMBER

(75) Inventors: James Creed, Clinton, OH (US); Grover Miller, Peninsula, OH (US); John F. Rasnick, Uniontown, OH (US)

(73) Assignee: A-1 Concrete Leveling Inc., Akron, OH (US)

( * ) Notice: Subject to any disclaimer, the term of this patent is extended or adjusted under 35 U.S.C. 154(b) by 0 days.

(21) Appl. No.: 10/374,434

(22) Filed: Feb. 25, 2003

(65) Prior Publication Data

US 2003/0208974 A1 Nov. 13, 2003

Related U.S. Application Data

(60) Provisional application No. 60/360,075, filed on Feb. 25, 2002, provisional application No. 60/364,376, filed on Mar. 13, 2002.

(51) Int. Cl.
*E02D 27/50* (2006.01)
*E02D 5/74* (2006.01)

(52) U.S. Cl. ..... 405/244; 405/230; 405/239

(58) Field of Classification Search ..... 405/230, 405/231, 244, 239; 52/169.9, 292
See application file for complete search history.

(56) References Cited

U.S. PATENT DOCUMENTS

| | | | | |
|---|---|---|---|---|
| 1,974,123 | A | | 9/1934 | Poulter |
| 1,976,857 | A | | 10/1934 | Poulter |
| 2,007,457 | A | | 7/1935 | Peters |
| 2,074,756 | A | | 3/1937 | Poulter |
| 2,631,435 | A | * | 3/1953 | Emshwiller ..... 405/244 |
| 4,308,736 | A | | 1/1982 | Lowe et al. |
| 4,444,276 | A | | 4/1984 | Peterson, Jr. |
| 4,667,500 | A | | 5/1987 | Mechtold et al. |
| 4,695,203 | A | * | 9/1987 | Gregory ..... 405/230 |
| 4,708,528 | A | | 11/1987 | Rippe |
| 5,056,210 | A | | 10/1991 | King, Jr. |
| 5,100,262 | A | * | 3/1992 | Michael et al. ..... 405/231 |
| 5,205,673 | A | | 4/1993 | Bolin et al. |
| 5,217,325 | A | | 6/1993 | Freeman, III |
| 5,243,845 | A | | 9/1993 | Velte |
| 5,518,275 | A | | 5/1996 | Mackay |
| 5,531,544 | A | | 7/1996 | Willcox, II |
| 5,722,798 | A | * | 3/1998 | Gregory ..... 405/230 |
| 5,800,094 | A | | 9/1998 | Jones |
| 5,924,341 | A | | 7/1999 | Brooks |
| 5,975,808 | A | * | 11/1999 | Fujita ..... 405/244 |
| 6,074,133 | A | | 6/2000 | Kelsey |
| 6,079,905 | A | | 6/2000 | Ruiz et al. |
| 6,142,712 | A | | 11/2000 | White et al. |

(Continued)

FOREIGN PATENT DOCUMENTS

JP 06108462 * 4/1994

(Continued)

*Primary Examiner*—Jong-Suk (James) Lee
(74) *Attorney, Agent, or Firm*—Brouse McDowell; Roger D. Emerson; Timothy D. Bennett

(57) ABSTRACT

A piering member includes a generally tubular body that has a flarable end so that when the piering member is inserted into the ground, the flarable end of the piering member can be flared outward to increase the area of support for the foundation that rests upon the piering members. The flarable pier includes slits formed in the body to allow a flaring member to force the segments of body, formed by the slits, outward. The flaring member may be inserted from the top of the piering member or may include a conically shaped flaring member inserted into the bottom of the pier.

7 Claims, 11 Drawing Sheets

U.S. PATENT DOCUMENTS

| | | | | |
|---|---|---|---|---|
| 6,152,654 | A | 11/2000 | Ruiz et al. | |
| 6,264,402 | B1 | 7/2001 | Vickars et al. | |
| 6,435,777 | B1 * | 8/2002 | Yoshii et al. | 405/244 |

FOREIGN PATENT DOCUMENTS

| | | |
|---|---|---|
| WO | 9851868 | * 11/1998 |

* cited by examiner

MECHANICAL DEVICE FOR FLARING A PILING MEMBER

This application claims priority from a U.S. Provisional patent application, Ser. No. 60/360,075, filed Feb. 25, 2002 and U.S. Provisional patent application, Ser. No. 60/364,376, filed Mar. 13, 2002.

I. BACKGROUND OF THE INVENTION

A. Field of Invention

This invention pertains to the art of methods and apparatuses for piering the foundation of a building.

B. Description of the Related Art

It is known in the art to drive a piling or a pier into the ground to support the foundation for a building. It is also known to raise a sunken foundation where the foundation has sunk due to settling of the ground. Typically, piering members, in predetermined sections having a characteristic length for example of three (3) or four (4) feet, are driven into the ground one directly on top of the other. Couplers may be used connect each subsequent pier. The piering members are then added and driven consecutively into the ground to the point of refusal. The foundation is then built upon or fixed to the piering members for support of the foundation. In the case of raising a sunken foundation, the piering members may be fastened to the foundation via bolts or the like.

One aspect of the piering members or pilings is that for a given diameter of a support tube, the piering members can only support weight proportionate to the diameter of the tube. This may result in the need to install additional piering members or piering members having a larger cross sectional diameter, adding to the cost of the materials. It would be beneficial to have a piering member that expanded its diameter after having been inserted into the ground to increase the surface area and amount of support for a given foundation.

II. SUMMARY OF THE INVENTION

According to one aspect of the present invention, a new and improved piering member is provided having a flarable section.

Another aspect of the present invention includes a flarable piering member having a flaring member received by the piering member.

Yet another aspect of the present invention includes a piering member having slits fashioned longitudinally in the wall of the piering member.

Still another aspect of the present invention includes a conically shaped flaring member that is received into the first flarable end of a generally tubular foundation support member.

The present invention relates to a piering system for supporting the foundation of a building structure. The piering system includes a foundation support member or pier that has at least a first flarable section. A flaring means is included that can selectively flare the flarable section of the support member, which can be a mechanical or hydraulic flaring member. The support member may include a flaring resistive device that prevents flaring of the support member until a predetermined force is reached; generally proximate to force experience at the point of refusal. Once the desired position of the piering members is reached, the support member is flared by forcing outward the flarable side portions of the support member.

A bracket may be used, which is fixedly attached to the foundation, for forcing the piering members into the ground. A hydraulic cylinder may be operatively connected to the bracket to supply force for driving the piering members. Once the point of refusal is reached and the support member is flared, the bracket is then fixedly secured to the piering members. Cementuous grout filler may be introduced between the gap, formed by raising the foundation, and the ground. However, type of filler may be used to fill this gap as chosen with sound engineering judgment.

Still other benefits and advantages of the invention will become apparent to those skilled in the art to which it pertains upon a reading and understanding of the following detailed specification.

II. BRIEF DESCRIPTION OF THE DRAWINGS

The invention may take physical form in certain parts and arrangement of parts, a preferred embodiment of which will be described in detail in this specification and illustrated in the accompanying drawings which form a part hereof and wherein.

Figure 2:
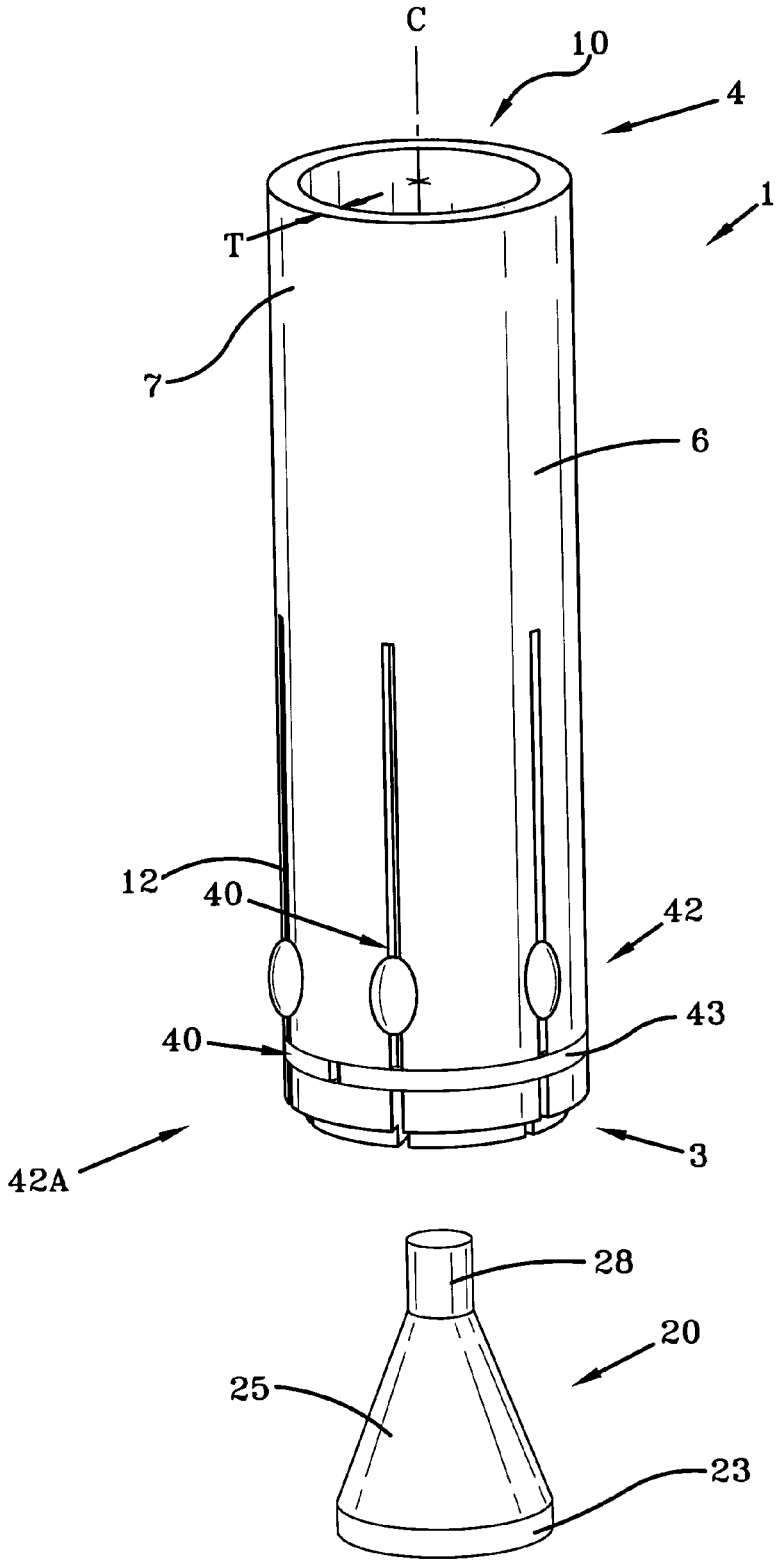
FIG. 2 is a perspective view of a foundation support member and flaring member.
Figure 2A:
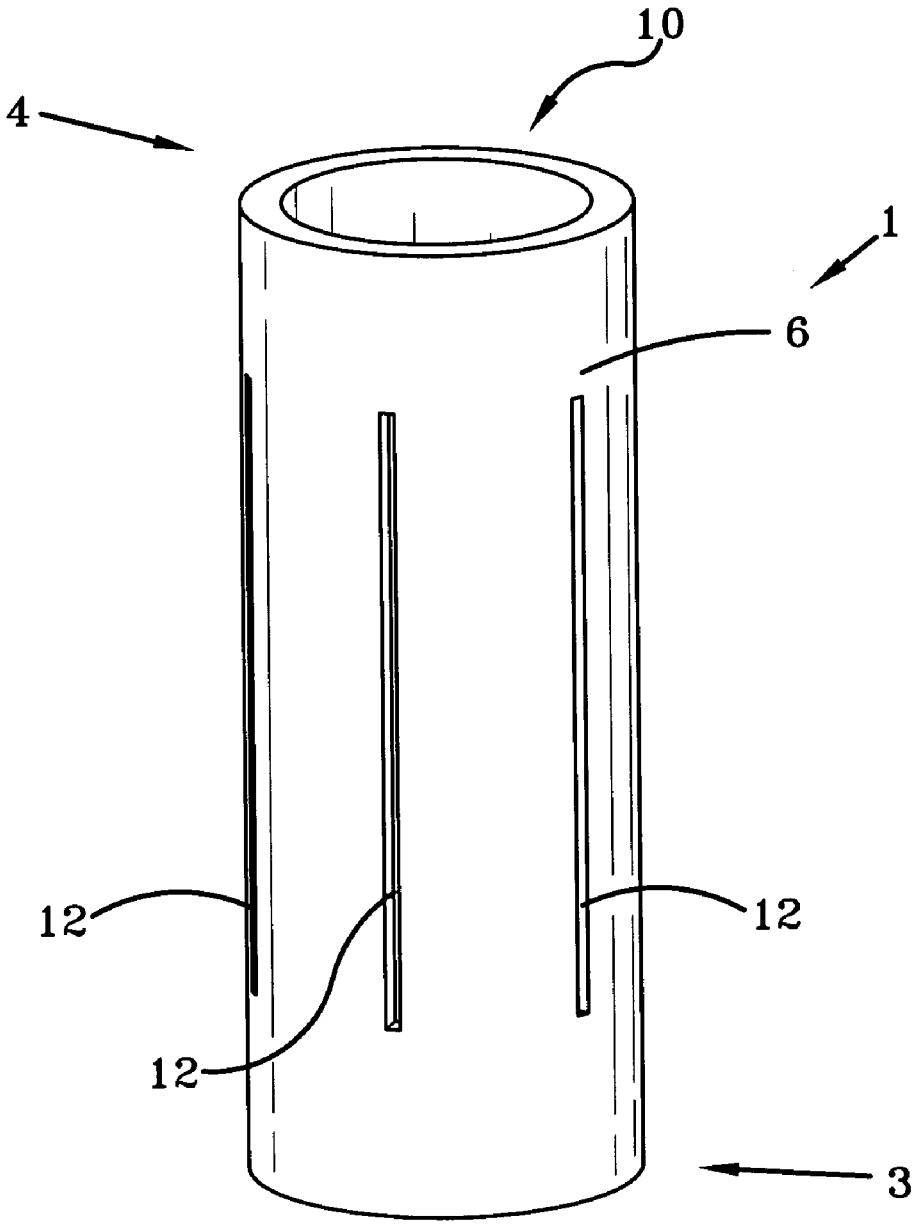

FIG. 2*a* is a perspective view of an alternate embodiment of a foundation support member.

Figure 2B:
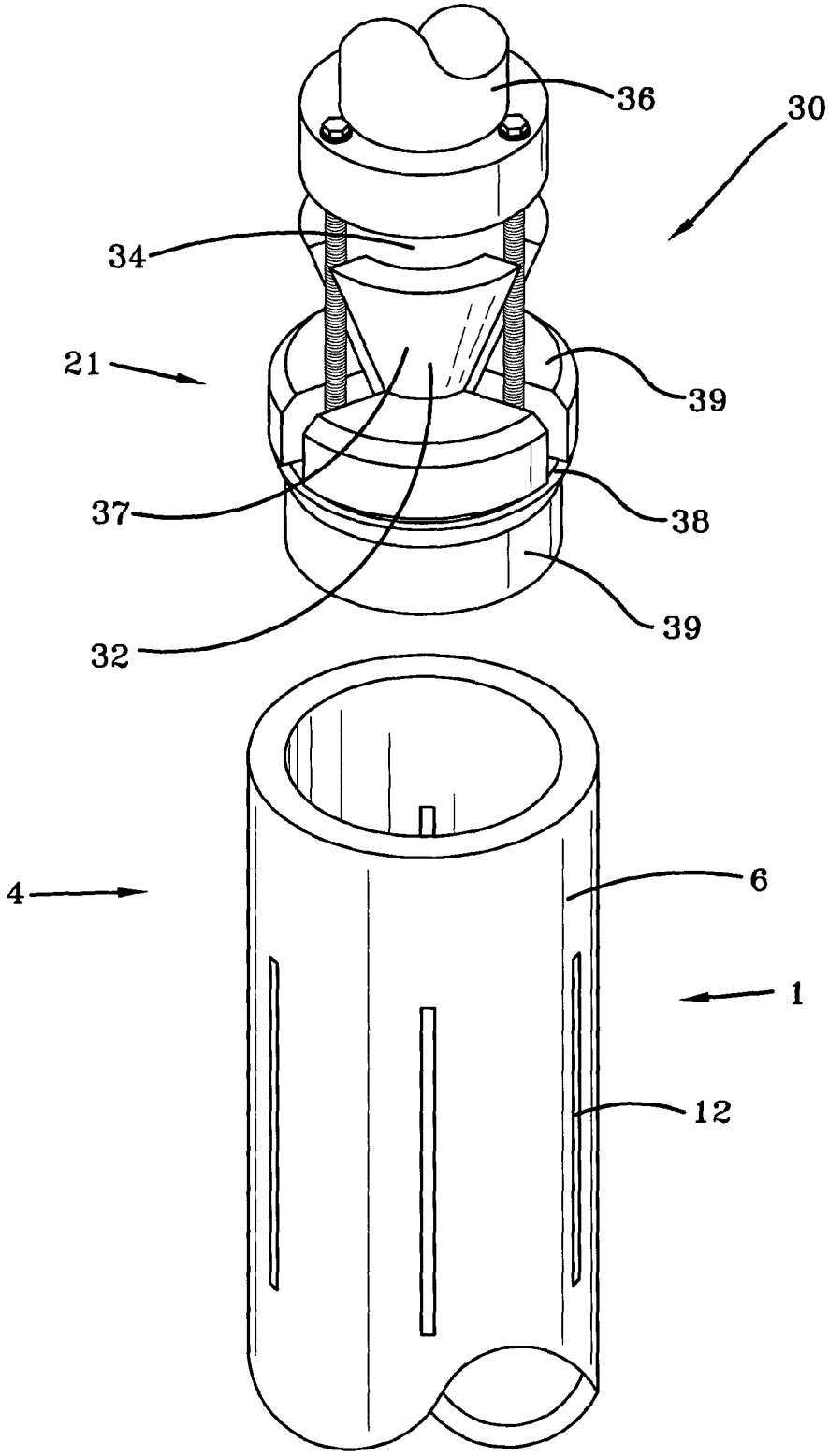

FIG. 2*b* is a perspective view of an alternate embodiment of a flaring member and the foundation support member.

Figure 3:
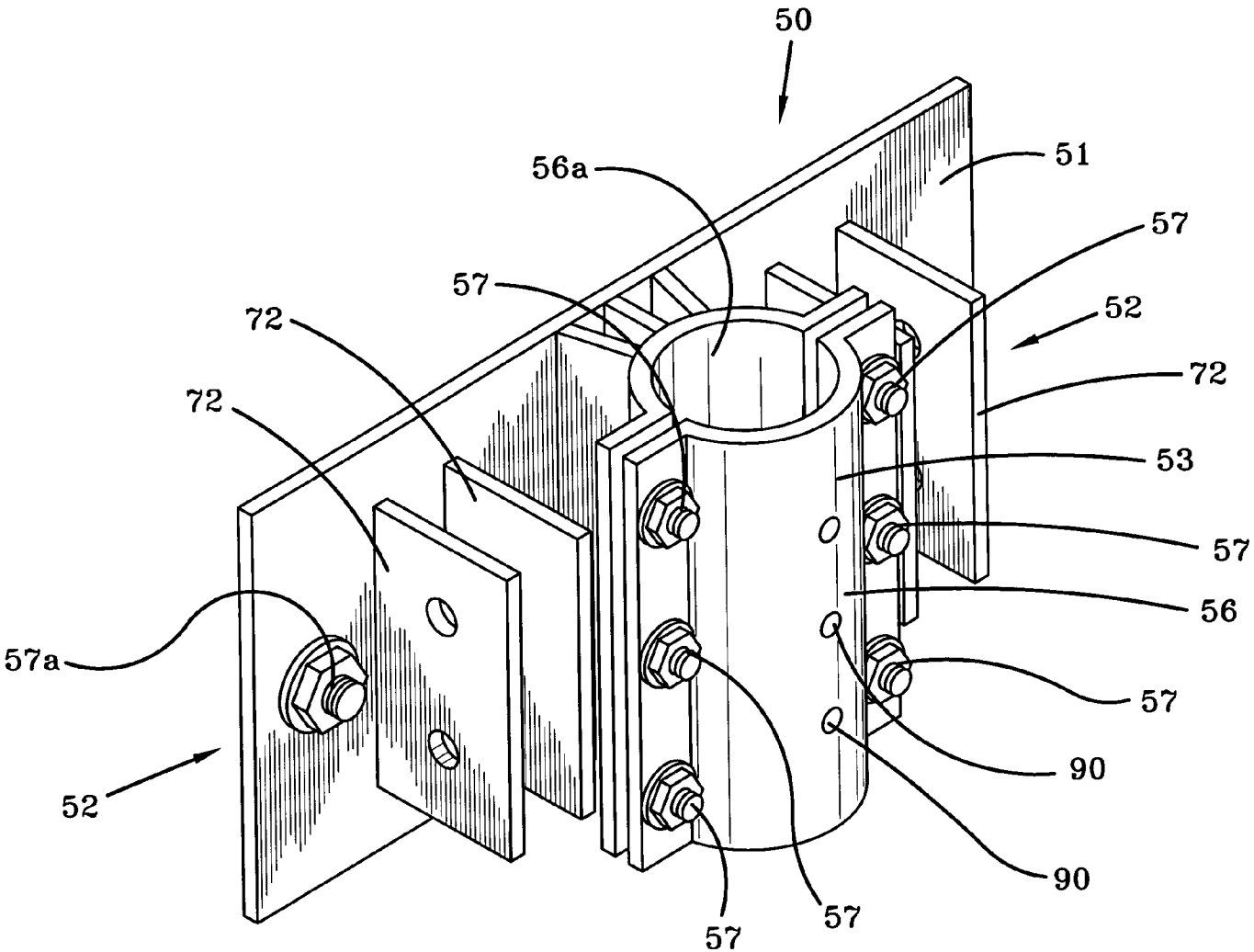

FIG. 3 is a perspective view of the building foundation bracket assembly.

Figure 3A:
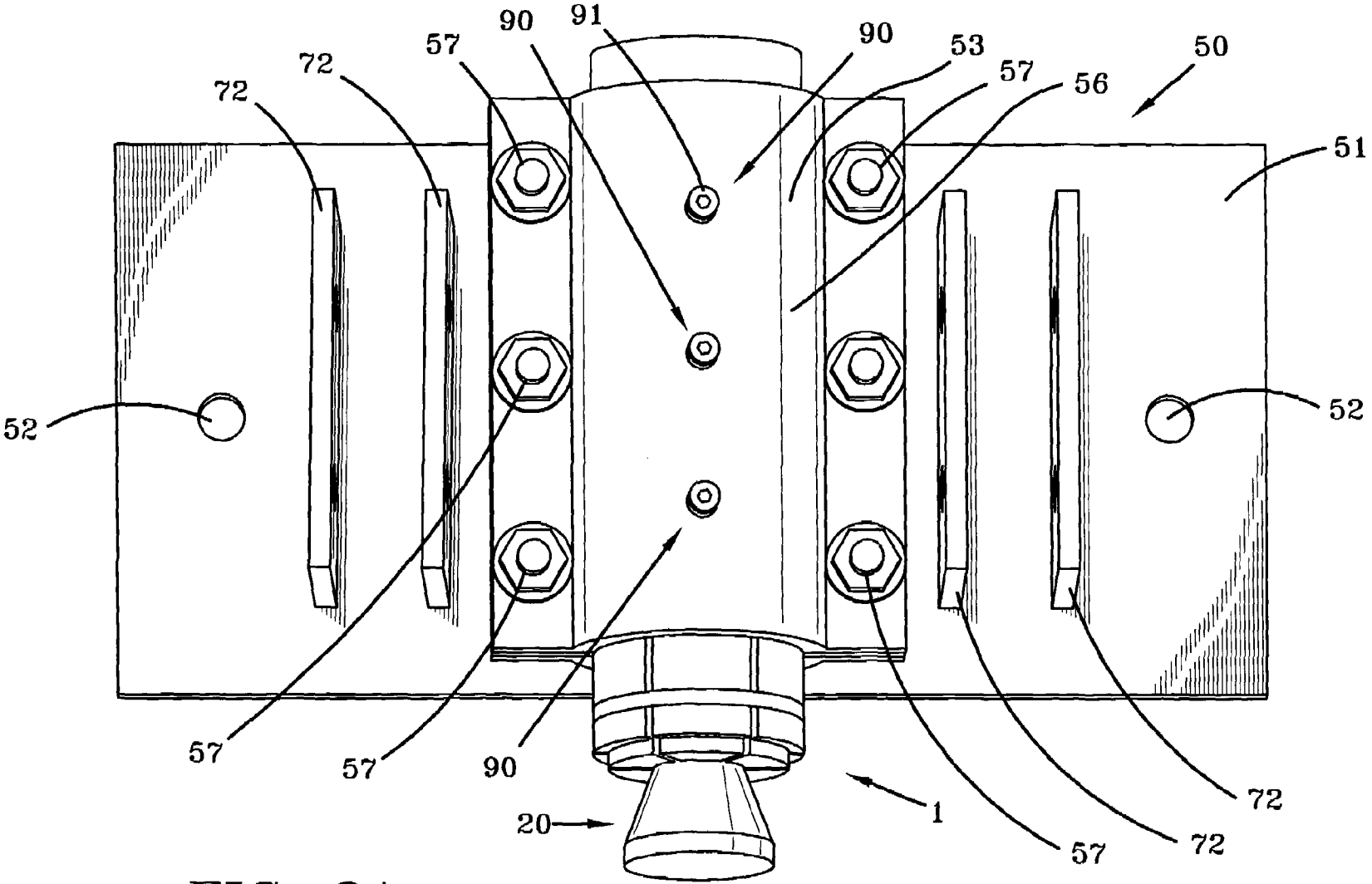

FIG. 3*a* is a perspective view of the building foundation bracket assembly and foundation support member with flaring member.

Figure 3B:
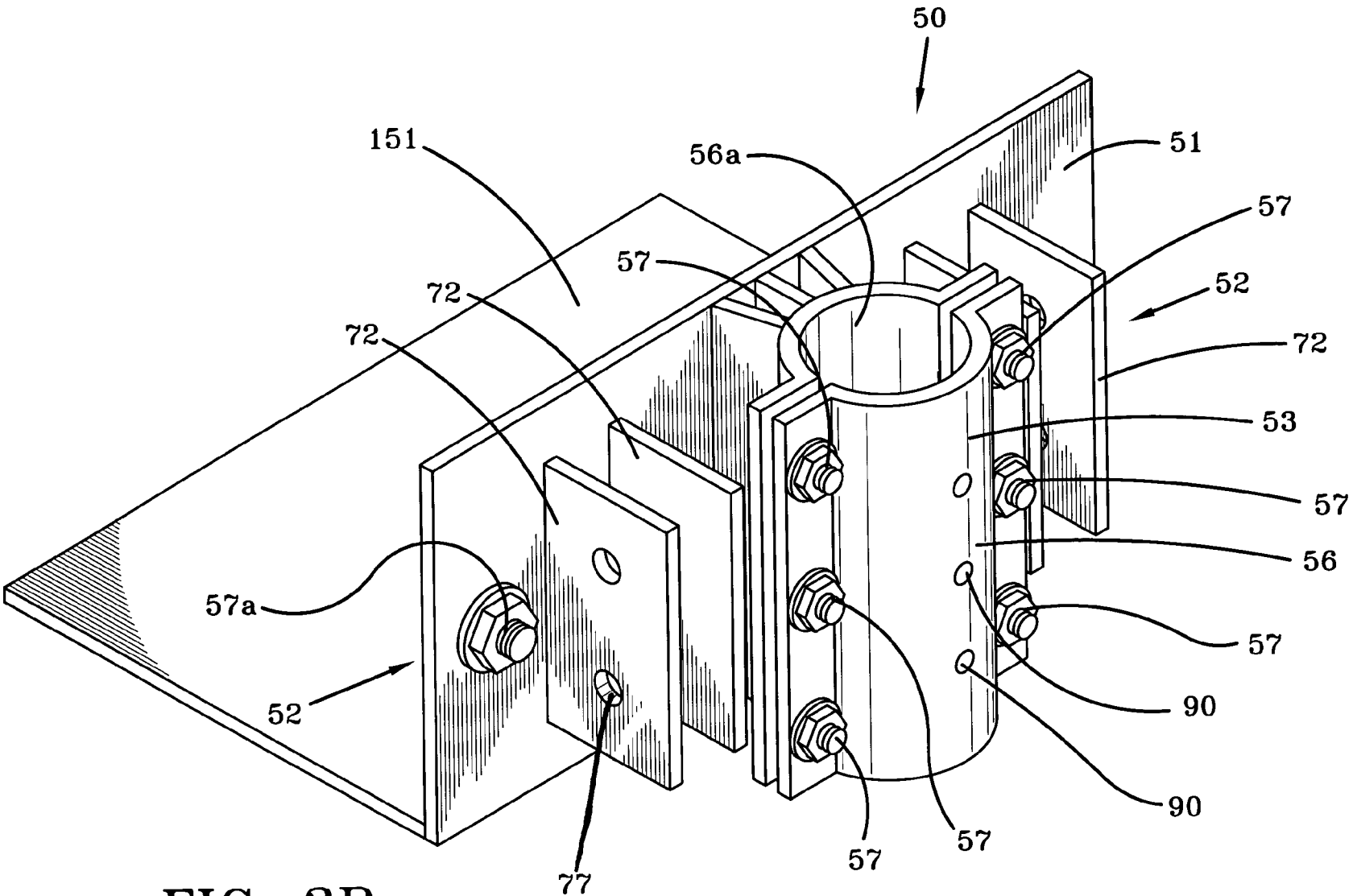

FIG. 3*b* is a perspective view of the building foundation bracket assembly with secondary extension member.

Figure 4:
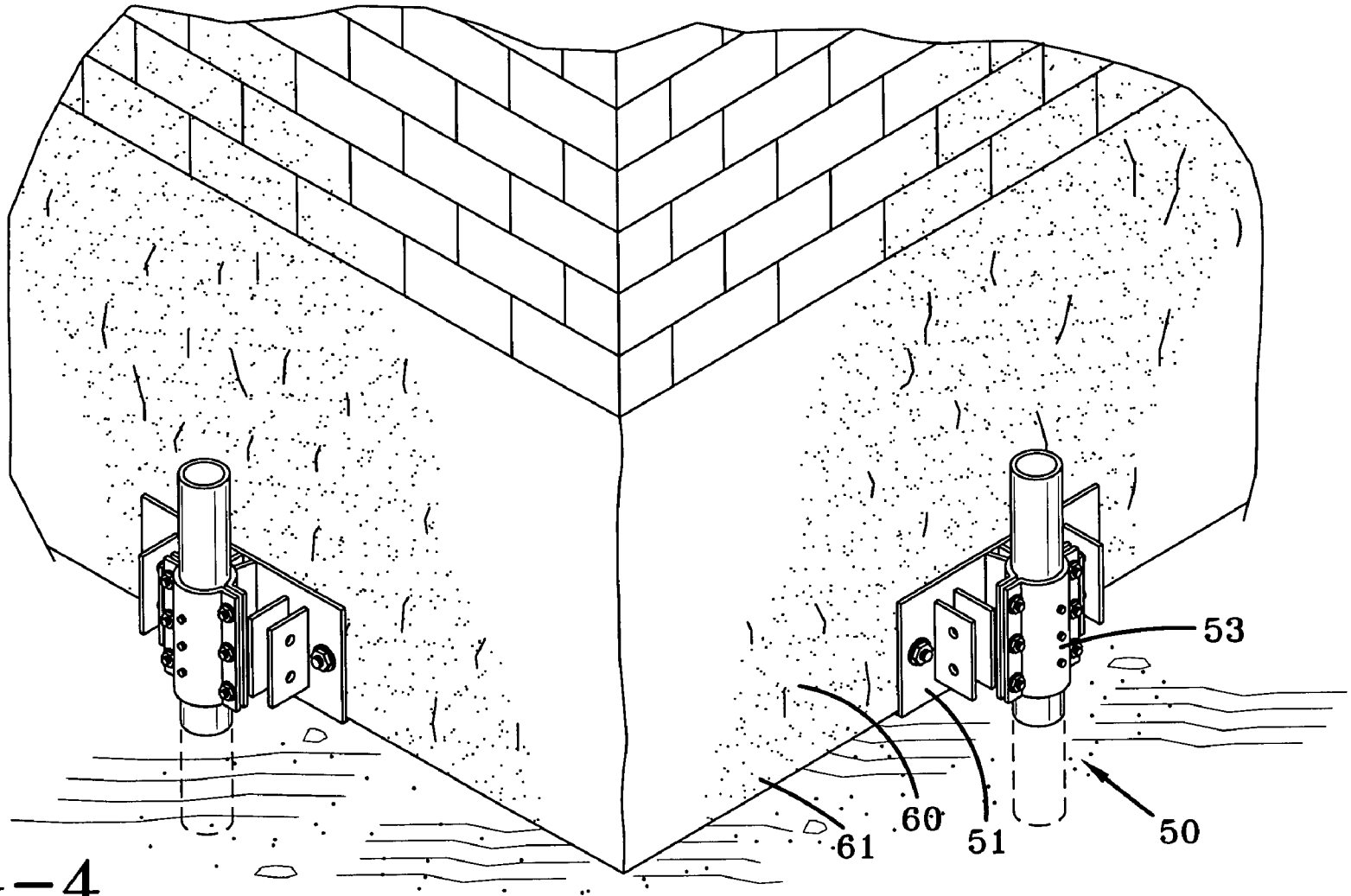

FIG. 4 is a perspective view of the building with the building foundation bracket assembly attached thereto and piering members.

Figure 5:
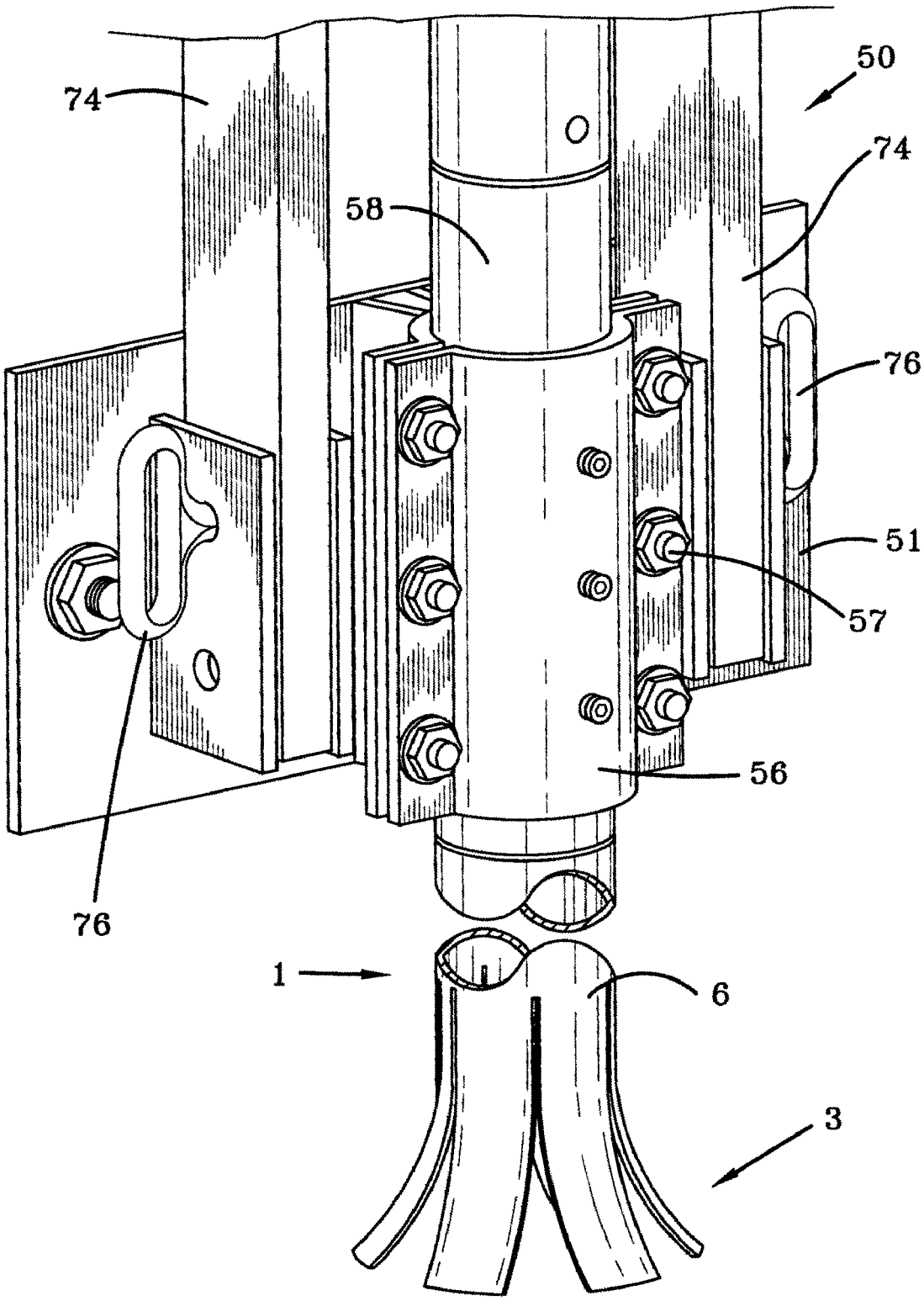

FIG. 5 is a front perspective view of the building foundation bracket assembly and piering members coupled together.

Figure 5A:
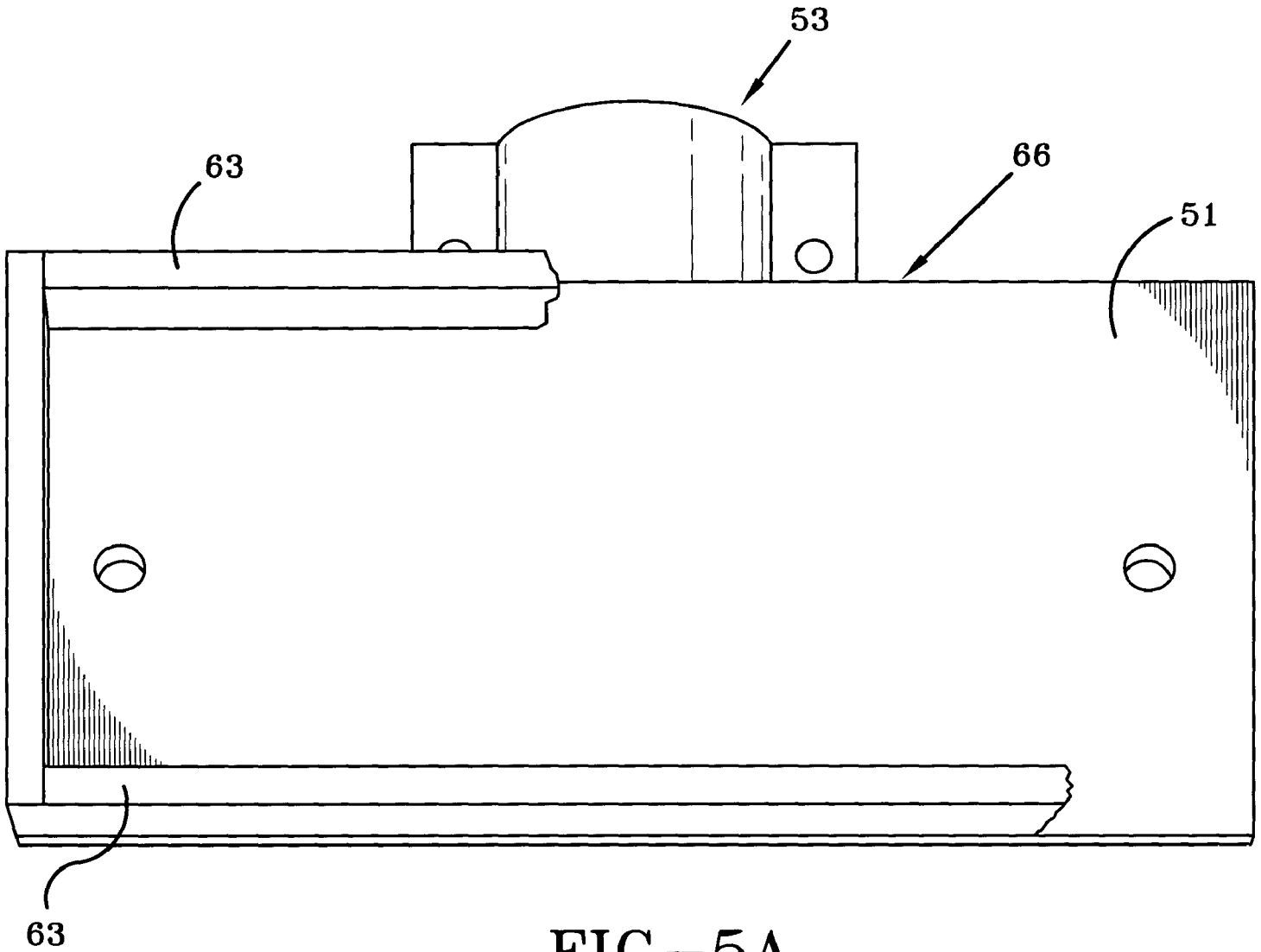

FIG. 5*a* is a rear perspective view of the building foundation bracket assembly.

Figure 6:
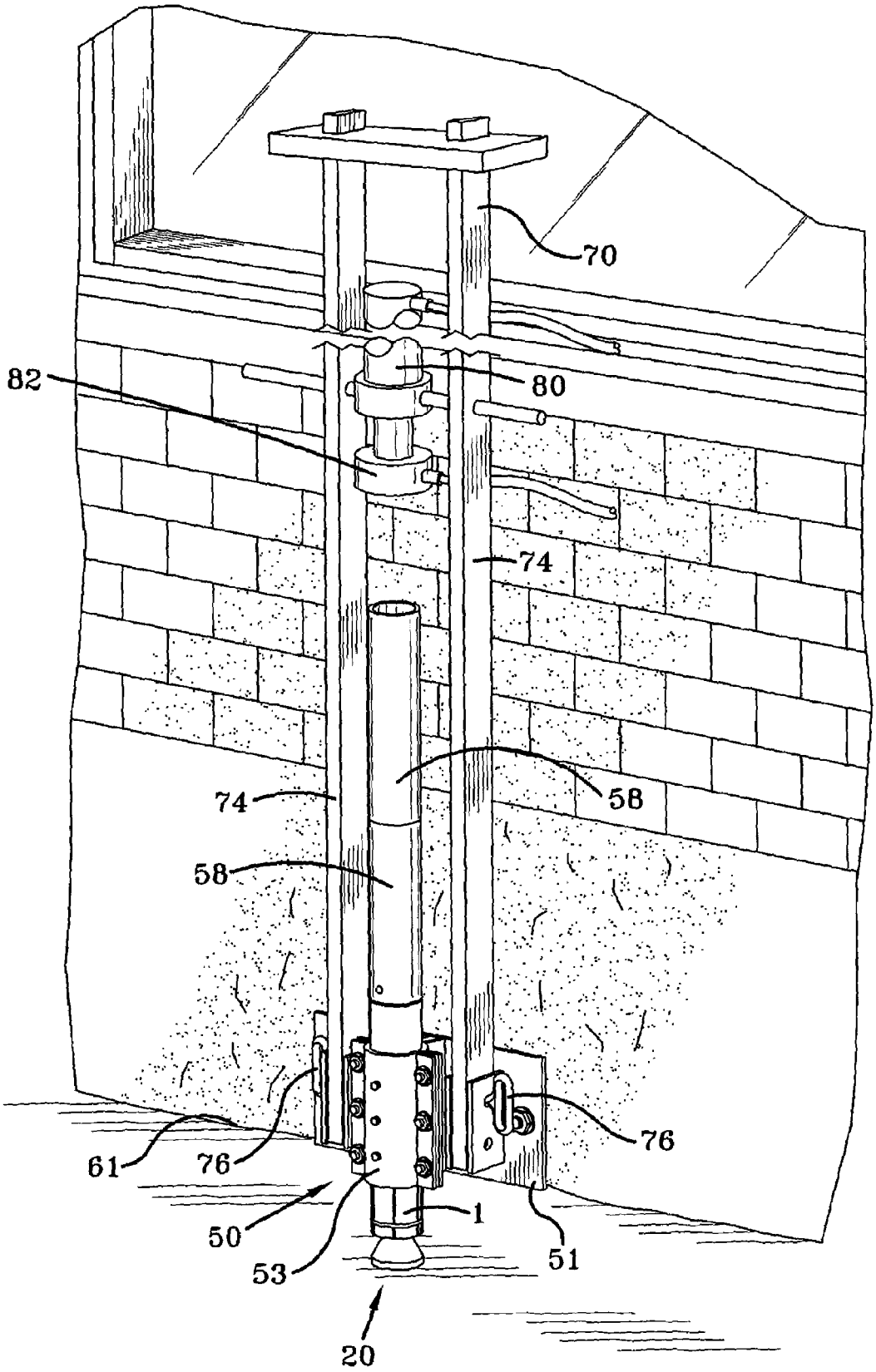

FIG. 6 is a perspective view of the building foundation bracket assembly, foundation support member and hydraulic means used to drive the foundation support member and piering members into the ground.

III. DESCRIPTION OF THE PREFERRED EMBODIMENT

Figure 1:
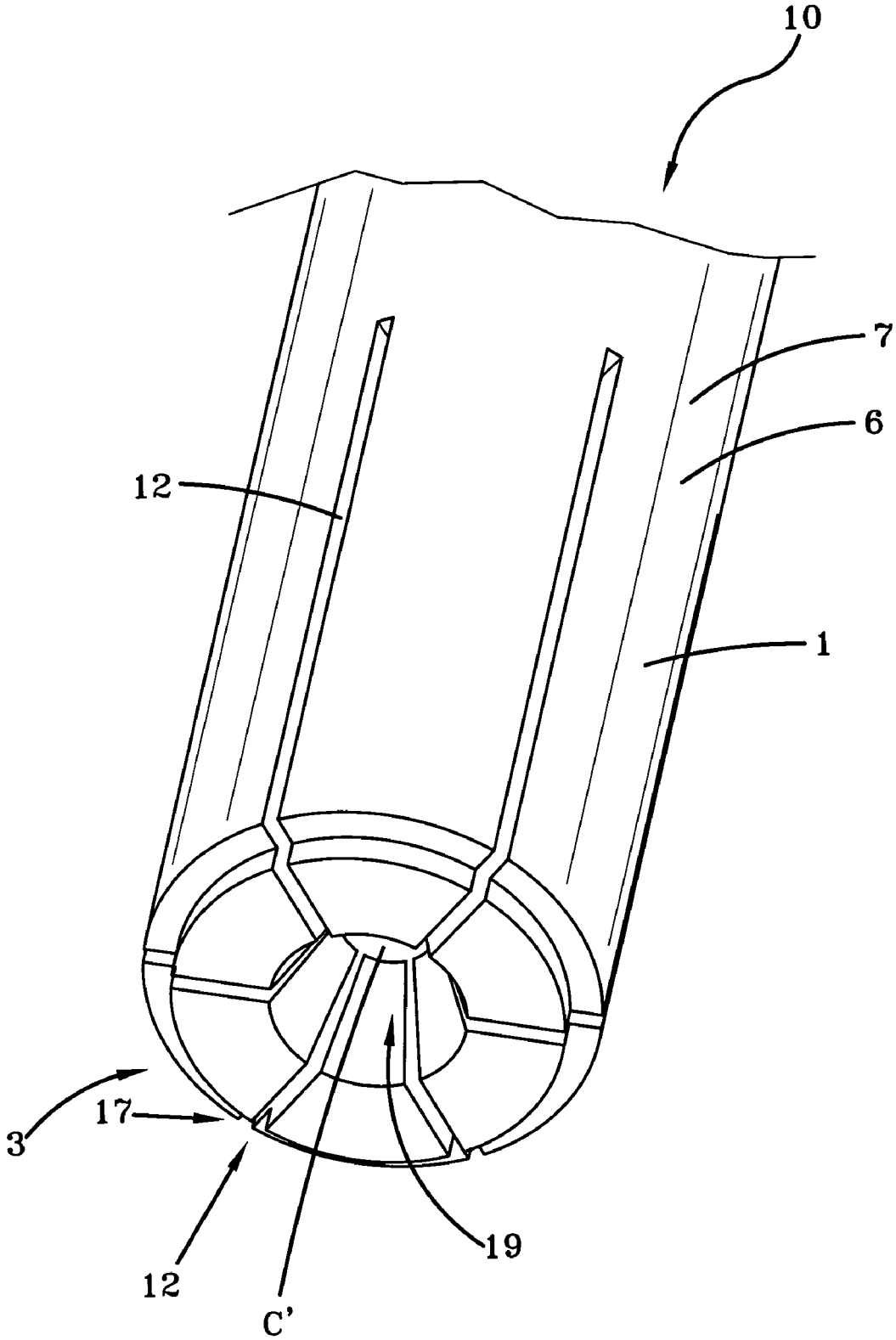
FIG. 1 is a perspective view of the foundation support member.

Referring now to the drawings wherein the showings are for purposes of illustrating a preferred embodiment of the invention only and not for purposes of limiting the same, FIGS. 1 and 2 show a piering member 1 or foundation support member 1 having first and second ends 3,4 respectively. The piering member 1 or foundation support member 1 may be generally tubular in shape as depicted in the Figures. It is noted that any configuration of the foundation support member 1 may be chosen with sound engineering judgment that deviates from a cylindrical or tubular shape and that is consistent with the following description. In the preferred embodiment, the foundation support member 1 may be three (3) feet in length. However, any length of foundation support member 1 may be chosen as is appropriate for use with the piering system described herein. Continuing, the foundation support member 1 includes a body portion 6. The body portion 6 may include a wall or wall portion 7 having a thickness T. The foundation support member 1 may include an inner region 10 defined by the circumference of the wall portion 7. It is noted that the thickness T of the wall portion 7 may be of any thickness as is appropriate for use with supporting the foundation of the building. In the preferred embodiment, the foundation support member 1 is constructed of a rigid metal. Metals used for the foundation support member 1 may be steel, iron alloy or any metal or alloy chosen with sound engineering judgment. It is also noted that any material other than metal may be used to construct the foundation support member 1 including but not limited to plastics and the like. The material used to construct the foundation support member 1 may be coated with a substance for preventing or assisting in preventing corrosion of the aforementioned material. Alternately, the material may have combined therein a substance for use in adding to the non-corrosive properties of the foundation support members. This is important because the foundation support members 1 are placed beneath the surface of the ground and may be subject to water or other corrosive substances.

With continued reference to FIGS. 1 and 2, as previously mentioned the foundation support member 1 has first 3 and second 4 ends. Slits 12 may be fashioned in the first end 3 of the foundation support member 1. In the preferred embodiment, the slits 12 may be formed parallel to the centerline axis C or a longitudinal axis of the foundation support member 1. Alternately, the slits may be fashioned at an angle with respect to the centerline axis C. Any angle of forming the slits 12 with respect to the centerline axis may be chosen with sound engineering judgment. The number of slits 12 formed in the foundation support member 1 may be six (6). However, any quantity of slits 12 may be fashioned in the foundation support 1 as chosen with sound engineering judgment. The slits 12 may be equidistantly fashioned about the periphery of the wall portion 7, which may be at 60-degree intervals. However, any degree of placement of the slits 12 may be chosen with sound engineering judgment. In the preferred embodiment, the slits 12 may be cut into the wall portion 7 as will be discussed in a subsequent paragraph. The slits 12 may have a length equal to substantially 50% of the overall length of the foundation support member 1. However, a range of lengths of the slits 12 may range from 15% to 75% of the overall length of the foundation support member 1. Alternately, any lengths or widths of slits 12 may be chosen with sound engineering judgment. It is expressly stated that any manner of fashioning, forming or constructing the foundation support member 1, wherein the foundation support member is flarable, may be chosen with sound engineering judgment.

With continued reference to FIGS. 1 and 2, and now to FIG. 2*a*, an alternate embodiment of the configuration of the slits 12 fashioned in the wall portion 7 of the foundation support member 1 is depicted. The slits 12 in the wall portion 7 may be fashioned, in a section or region of the foundation support member 1, substantially away from the ends of the foundation support member 1. In other words, the slits 12 may be longitudinally fashioned in the middle of the foundation support member 1. It is noted at this point, that the slits 12 may be fashioned to any appropriate length chosen with sound engineering judgment and at any place along the length of the foundation support member 1.

With continued reference to FIG. 2, a flaring member 20 is depicted generally at 20. The flaring member 20 may be received into the first end 3 of the foundation support member 1. It is noted at this point, the flaring member 20 may be received into the foundation support member 1 proximate to the slits 12, wherein the flaring member 20 engages the foundation support member 1 to flare an end of the foundation support member 1. The flaring member 20 may include a base portion 23, a flaring portion 25 and an insert portion 28. The flaring portion 25 may extend from the base portion 23 to the insert portion 28. In the preferred embodiment, the flaring portion 25 may be conically shaped. The length of the cone or the angle at which the sides of the cone are fashioned may be any length or angle chosen with sound engineering judgment as is appropriate for flaring the first end of the foundation support member 1 in a predetermined fashion. In the preferred embodiment, the conically shaped flaring portion 25 may cause flaring of the first end 3 of the foundation support member 1, such that, the respective outer diameter of the flared end of the foundation support member 1 may extend from 1 to 4 times the diameter of the second end of the foundation support member 1. The base portion 23 may have a configuration and shape similar to the second end 4 of the foundation support member 1. The insert portion 28 of the flaring member 20, as previously mentioned, may be received into the first end 3 of the foundation support member 1. A channel 19, shown in FIG. 1, may be fashioned in the first end 3 of the foundation support member 1 for use in receiving the insert portion 28 of the flaring member 1 as will be discussed in a subsequent paragraph. As the insert portion 28 of the flaring member 20 is received into the channel 19 of the first end 3 of the foundation support member 1, no force is transferred to the walls 7 of the foundation support member 1. As the flaring member 20 is longitudinally forced further into the foundation support member 1, the flaring portion 25 engages the walls 7, fashioned with slits 12, forcing the walls 7 outward. In this manner, the foundation support member 1 is flared at a first end 3 or at a first section. It should be noted that the base diameter of the flaring member 20, and more specifically the diameter of the lower portion of the conically shaped flaring portion 25, determines the extent of flaring exerted onto the foundation support member 1. Therefore, the flaring member 20 causes the flarable foundation support member 1 to be flared when the flaring member 20 is inserted and driven into an end of the foundation support member 1. It is noted that any configuration of the flaring member 20 may be chosen with sound engineering judgment as is appropriate for flaring an end or middle section of the foundation support member 1. Additionally, the flaring member 20 may be constructed of any material chosen with sound engineering judgment.

With reference now again to FIG. 1, the channel 19 of the first end 3 of the foundation support member is shown. The channel 19 may be fashioned by inserting a plug member, shown generally at 17, into the foundation support member 1 at the point where it is desired to form slits 12 in the foundation support member 1. In the preferred embodiment, the plug member 17 is inserted and fixed in place at the first end 3 of the foundation support member 1. However, the plug member 17 may be fixed at any position along the length of the foundation support member 1 as is appropriate for flaring a section of the foundation support member 1. The plug member 17 may be welded in place or fixed in place by any means well known in the art. Alternately, it is contemplated that the foundation support member 1 with channel 19 is integrally formed with the plug member 17 by any means chosen with sound engineering judgment. After the plug member 17 is fixedly secured in place as shown, the slits 12 may be cut or fashioned in the first end 3 of the foundation support member 1 and the plug member 17 simultaneously. However, it should be noted that any manner of fashioned the channel 19 and the slits 12 may be chosen with sound engineering judgment. The size and configuration of the channel 19 may correspond in size and configuration to the insert portion 28 of the flaring member 20. In this way, the sides of the channel 19 contact the flaring portion 25 of the flaring member 20 forcing the walls 6 outward resulting in the flaring of the foundation support member.

With reference to FIG. 2*b*, a hydraulically actuated flaring member is shown generally at 30. In an alternate embodiment, the hydraulically actuated flaring member 30 may be a hydraulic cylinder 36 connected to an expanding flaring member 21 having segments 39. The cylinder 36 and flaring member 21 may be inserted into the second end 4 of the foundation support member 1 to the point at which flaring of the foundation support member 1 is desired. Afterward, the cylinder 36 may be engaged, extending a cylinder rod 34, which causes the flaring member 21 to expand thus forcing the walls 7 outward. The flaring member 21 may include separable sections 37, as shown in the Figure, having a conical outer surface 32. A flexible retracting ring 38 may be communicated around the flaring member 21 causing the segments 39 to retract when hydraulic power has been released from expanding the flaring member 21. In this manner, the flaring member 21, in a non-expanded state, may be inserted into the second end 4 of the foundation support member, positioned at the point of flaring, actuated to expand the segments causing flaring of the foundation support member 1, disengaged wherein the segments automatically retract and removed from the end of the foundation support member 1.

With reference now again to FIG. 2, a flaring restriction means is shown generally at 40. In the preferred embodiment, the flaring restriction means 40 is a flaring restriction ring 43. The ring 43 may be received onto the foundation support member 1 at a position to restrict the flaring of the walls 7 formed by the slits 12. The foundation support member 1 may include a groove shown generally at 42 to hold the ring 43 in place. However, any means of positioning and holding the ring 43 in place may be chosen with sound engineering judgment. Alternately, the flaring restriction means 40 may be welds applied across the slits 12 to restrict flaring outward. Any number and configuration of welds may be chosen as is appropriate for selectively applying resistance to inhibit flaring of the foundation support member 1. The flaring restriction means 40 may break or disengage from restricting the outward flaring of the flaring section of the foundation support member 1. In the preferred embodiment, the flaring restriction means 40 is selectively designed to disengage when the foundation support member 1 has reached the point of refusal as will be discussed in a subsequent paragraph. It is noted that the dimensions, thickness, width, type of material, quantity, etc., of the flaring restriction means 40 may be chosen at will to selectively cause the flaring restriction means 40 to disengage at any desired predetermined force. It is expressly stated that any manner of selectively restricting the flaring of the foundation support member 1 may be chosen with sound engineering judgment.

With continued reference to FIG. 2, alternately, the flaring restriction means 40 may have a groove 42A cut or fashioned into the flaring restriction means 40. The groove 42A may vary in width and/or depth to selectively allow for the breaking of the flaring restriction means 40. Alternately, the groove 42A may be angled with respect to a centerline axis of the flaring restriction means 40. Any number of groves 42A may be formed in the flaring restriction means 40 as chosen with sound engineering judgment. In this manner, the flaring restriction means 40 may have a single general configuration, which made be selectively altered to break at predetermined stresses by forming grooves 42A with different dimensions cut therein. In this manner, the groove 42A determines when the flaring restriction means 40 breaks releasing the piering member to be flared as discussed herein. For example, a first groove having a first groove depth would allow the flaring restriction means 40 to break at a first tension force F. A second groove may be fashioned in a similar flaring restriction means 40 having a deeper groove 42A cut therein allowing the flaring restriction means 40 to break at a force F/2. In this manner, the flaring restriction means 40 may be selectively configured to break at a predetermined force. It should be noted that the groove 42A maybe formed on any portion of the flaring restriction means 40 as chosen with sound engineering judgment.

The operation of the piering system will now be discussed. As discussed, the piering system may include the foundation support member 1 and the flaring member 20. The insert portion 28 may be inserted into the first end 3 of the foundation support member 1 and the whole pier placed on the ground where it is desired to drive the pier downward into the earth. Force may then be applied to the second end 4 of the foundation support member 1 for use in driving the pier downward. In this manner, the foundation support member 1 and the flaring member 20 are driven at the same rate downward into the ground. It is noted that the flaring restricting means 40 inhibits the first end 3 of the foundation support member 1 from flaring outward in a manner consistent with the previous discussion. As the foundation support member 1 is driven downward, additional piering members or pilings may be coupled to the initial foundation support member 1 to increase the overall length of the piering system. These additional piering members may not be flarable but may be solidly formed tubular components for use in transferring force to the foundation support member 1. When the point of refusal is reached, the flaring restriction means 40 will disengage allowing the flaring member 20 to be driven into the first end 3 of the foundation support member 1. This causes the walls 7 at the first end 3 to flare outward increasing the surface area of the foundation support member 1 and the amount of weight that the foundation support member 1 can support thus increasing the overall effectiveness of the piering system, reference FIG. 5*a*. After the point the refusal has been reached, cement or other aggregate may be poured into the inner region 10 filling the inner region of the piering members and the foundation support member 1 further increasing the strength of the support of the piering system.

With reference now to FIGS. 3 and 3*a* and 5*a*, a building foundation bracket assembly 50 is shown that may receive the foundation support member 1. The bracket assembly 50 may include a back plate 51. The back plate 51 may include holes 52 for mounting the back plate 51 to the foundation of a structure or building, shown in FIG. 4. Mounting bolts 54 may be used to secure the bracket assembly 50 to the associated structure. Alternately any means of securing the bracket assembly 50 to the structure may be chosen with sound engineering judgment including adhesives, chemical fastening means, other mechanical fasteners and the like. The back plate 51 may have attached thereto a clamping assembly 53. The clamping assembly 53 may include first and second clamping assembly members 56, 56*a*. The second clamping assembly member 56*a* may be fixedly connected to the back plate 51. Subsequently, the first clamping assembly member 56 may be selectively coupled to the second clamping assembly member 56*a* via bolt fasteners 57. In the non-engaged state, the first member 56 of the clamping assembly 53 may be loosely coupled to the second member 56*a* of the clamping assembly 53 to allow the foundation support members 1 and piering members 58 to slide downward through the clamping assembly 53. Once the piering members 58 have been driven down into the earth, the clamping assembly 53 may be tightened to hold the piering members 58 in place, as will be discussed further in a subsequent paragraph. In this manner, the bracket assembly 50, after having been fixed to the structure foundation, may be securely connected to the piering members 58 for supporting the foundation of the structure. Additionally, bores 90 may be fashioned in the first clamping member 56 that received setscrews 91. After the clamping assembly 53 is tightened, setscrews 91 may be screwed in to engage the wall of the piering members 58. In this manner, the setscrews 91 may penetrate the piering members further preventing movement of the piering member 58 with respect to the bracket assembly 50.

With continued reference to FIGS. 3 and 3*a* and now to FIGS. 4 and 5 and 5*a*, FIG. 4 depicts the bracket assembly 50 fixedly secured to the foundation 60 of the associated building. It is noted that the foundation 60 of the associated building may be rough and uneven as is well known in the art. Therefore, it may be necessary to fashion or cut a flattened surface 61 in the foundation 60 for receiving the reverse side of the bracket assembly 50. Even though the flattened surface 61 may be smoother than the surrounding foundation surface, there may still be gaps between the surface 61 and the back plate 51 when juxtaposed to each other. FIG. 5 shows the reverse side of the back plate 51 with a wall-containing portion 63. The wall-containing portion 63 may be extended about the perimeter of the edges 66 of the back plate 51. FIG. 5 shows a partial cutaway of the wall-containing portion 63 for clarity. However, it is to be understood that the wall-containing portion 63 extends around the entire perimeter of the back plate 51. The wall-containing portion 63 extends outward away from the back plate 51 to form a raised perimeter that may contain hydraulic cement or other substance, not shown. The wall-containing portion 63 may include an adhesive side that adheres to the back plate 51. It is noted that any manner of fashioning and affixing a raised perimeter may be chosen with sound engineering judgment. Hydraulic cement may be poured into the raised perimeter formed by the wall-containing portion 63. Subsequently, the back plate 51 may be juxtaposed to the foundation 61, pressed into place and secured thereto with bolts 57*a*. Prior to hardening, the cement conforms to the uneven surface on the foundation, which maximizing surface contact between the back plate 51 and the foundation surface 61. It is noted that any such aggregate or hardening substance may be chosen with sound engineering judgment that is consistent for use with the present invention. Alternately, the back plate 51 with raised perimeter may first be secured to the foundation surface 61, wherein hydraulic cement or other substance may subsequently be filled into the volume there between.

With reference to FIG. 3*b*, it is contemplated in an alternate embodiment that the back plate 51 may have extended therefrom a second member 151. The second member 151 may be a planar member fixedly connected to the back plate 51. However, the second member 151 may be any configuration of member that extends generally perpendicular from the back plate 51 including rods and the like. The second member 151 may be inserted into the foundation or structure of the unit being raised or supported. In other words, a slot may be cut or fashioned in the foundation for receiving the second member 151. In this manner, the back plate 51 is prevented from twisting during insertion of the piering members. A filler or cementuous grout may be inserted into the slot to fill any gaps between the second member 151 and the foundation. It is noted at this point that the second member 151 may be angled with respect to the back plate 51. Additionally, any configuration of angle may be chosen with sound engineering judgment.

With reference now to FIGS. 6, the bracket assembly 50 is shown attached to the associated building at the foundation surface 61. The foundation support member 1 is operatively received by the clamping assembly 53. In this position, the foundation support member 1 is positioned against the ground. In other words, the flaring member 20 abuts the earth prior at the point where it is to be driven into the earth as will be described in a subsequent paragraph. It is noted at this point that the clamping assembly 53 is not tightened, but remains unclamped to allow the foundation support member 1 and the piering members 58 to slide through the clamping assembly 53 during the insertion process. A force-driving frame 70 is shown connected to the bracket assembly 50 at flange members 72, shown in FIG. 3. The flange members 72 may extend from the front side of the back plate 51. The bracket assembly 51 may include four separate flange members 72 as shown in clearly in FIG. 3*a*; separated by the clamping assembly 53 with two (2) flanges on each side. Each pair of flange members 72 works in conjunction to receive the force-driving frame 70. The force-driving frame 70 may include frame support members 74 that connect into the flange members 72. Pins 76 may be inserted through a hole 77 in one flange member 72, into the frame support member and then through a second flange member 72. The opposite side of the frame support member 74 is connected in a similar way. The force-driving frame 70 may be constructed of any material that allows for the transmission of tension forces through the frame support members 74. It is noted that tension and compression forces may be transmitted through the force-driving frame 70.

With continued reference to FIGS. 5*a* and 6, a hydraulic cylinder 80 is shown attached to the force-driving frame 70. The cylinder 80 may be connected to a hydraulic supply, not shown, in a manner well known in the art. A piering cup 82 may be rigidly attached to the rod of the cylinder 80. The piering cup 82 may be cylindrical in shape and sized to receive the piering members 58. As the cylinder 80 is engaged, the driving cup 82 may contact the piering members 58 driving them downward into the earth. Initially, force from the cylinder 80 works against the foundation of the associated building driving the foundation support member 1 and the piering member 58 into the ground. After reaching the point of refusal, force is transmitted through force-driving frame 70 against the piering member 58 to lift the foundation of the associated building. The clamping assembly 53 is then tightened to secure the piering members in place thereby supporting the foundation of the building.

The preferred embodiments have been described, hereinabove. It will be apparent to those skilled in the art that the above methods may incorporate changes and modifications without departing from the general scope of this invention. It is intended to include all such modifications and alterations as far as they come within the scope of the appended claims or the equivalents thereof. Having thus described the invention, it is now claimed:

We claim:

1. A method comprising the steps of:

providing a first foundation support member for use in supporting the foundation of an associated structure, the first foundation support member comprising a first end with a selectively flarable section;

driving the first foundation support member, the first end first, into the earth until the first foundation support member reaches the point of refusal; and, automatically flaring the selectively flarable section of the first foundation support member, by:

driving a flaring member into the first end of the first foundation support member; and, flaring walls of the first end of the first foundation support member outwardly.

2. The method of claim 1 wherein the step of, driving the flaring member into the first end of the first foundation support member, comprises the step of:

breaking a flaring restriction ring positioned around the first end of the first foundation support member.

3. The method of claim 1 wherein after the step of, automatically flaring the selectively flarable section of the first foundation support member, the method comprises the steps of:

clamping the first foundation support member to the foundation; and, attaching at least a first set screw through a clamping assembly member and against the first foundation support member.

4. The method of claim 1 wherein:

prior to the step of, driving the first foundation support member, the first end first, into the earth until the first foundation support member reaches the point of refusal, the method comprises the steps of: (a) providing a bracket assembly; (b) fashioning a raised perimeter to the bracket assembly; (c) attaching the bracket assembly to the foundation; and, (d) pouring cement into the raised perimeter; and, wherein after the step of, automatically flaring the selectively flarable section of the first foundation support member, the method comprises the step of: attaching the first foundation support member to the bracket assembly.

5. The method of claim 1 wherein:

prior to the step of, driving the first foundation support member, the first end first, into the earth until the first foundation support member reaches the point of refusal, the method comprises the steps of: (a) providing a bracket assembly; (b) providing a second member extending substantially perpendicular from the bracket assembly; and, (c) attaching the bracket assembly to the foundation by inserting the second member into the foundation; and, wherein after the step of, automatically flaring the selectively flarable section of the first foundation support member, the method comprises the step of: attaching the first foundation support member to the bracket assembly.

6. The method of claim 1 wherein after the step of, automatically flaring the selectively flarable section of the first foundation support member, the method comprises the step of:

pouring aggregate into an inner region of the first foundation support member.

7. The method of claim 1 wherein:

after the step of, providing a first foundation support member for use in supporting the foundation of an associated structure, the method comprises the step of: providing a second foundation support member; and, the step of, driving the first foundation support member, the first end first, into the earth until the first foundation support member reaches the point of refusal, comprises the steps of: (a) attaching the second foundation support member to the first foundation support member; and, (b) driving the second foundation support member into the earth.

* * * * *